United States Patent [19]

Horst

[11] Patent Number: 4,791,274

[45] Date of Patent: Dec. 13, 1988

[54] ELECTRIC FINNED-TUBE BASEBOARD SPACE HEATER EMPLOYING A VAPORIZED WORKING FLUID

[76] Inventor: Paul V. Horst, 7333 Old Post Rd., Boulder, Colo. 80301

[21] Appl. No.: 21,496

[22] Filed: Mar. 4, 1987

[51] Int. Cl.[4] ..... F22D 1/28; F24H 3/06; H05B 3/00; F24D 13/04

[52] U.S. Cl. ..... 219/341; 165/55; 219/365; 237/17

[58] Field of Search ..... 219/341, 365–368; 237/16–18; 165/55

[56] References Cited

U.S. PATENT DOCUMENTS

| | | | |
|---|---|---|---|
| 1,007,000 | 10/1911 | Gold | 219/341 |
| 1,043,922 | 11/1912 | Gold | 219/341 |
| 1,241,244 | 9/1917 | Palmer | 219/341 |
| 1,866,221 | 7/1932 | Pennington | 219/341 |
| 1,919,204 | 7/1933 | Decker | 219/341 |
| 1,945,815 | 2/1934 | Landerman | 219/362 X |
| 2,041,116 | 5/1936 | Dekermor | 219/341 X |
| 2,276,407 | 3/1942 | Manzer | 219/341 X |
| 2,477,778 | 8/1949 | Wright | 219/365 |
| 2,481,963 | 9/1949 | Witte et al. | 219/365 X |
| 3,640,456 | 2/1972 | Sturgis | 219/341 X |
| 3,927,299 | 12/1975 | Sturgis | 219/341 X |
| 4,223,205 | 9/1980 | Sturgis | 219/341 X |
| 4,427,875 | 1/1984 | Fleming | 219/341 |
| 4,518,847 | 5/1985 | Horst et al. | 219/341 X |
| 4,567,351 | 1/1986 | Kitagawa et al. | 219/341 |

*Primary Examiner*—Anthony Bartis
*Attorney, Agent, or Firm*—Edwin L. Spangler, Jr.

[57] ABSTRACT

An electrically-powered space heater has a boiler connected to supply a vaporized working fluid consisting of a 2 to 1 mixture of ethylene glycol and water to a slightly upwardly inclined, closed-end, finned-tube heater exchanger at a pressure of between −5 p.s.i. and 15 p.s.i. and at a temperature of between approximately 190° F. and 250° F. The combined internal volume of the boiler and heat exchanger is between about seventeen and twenty cubic inches with the boiler having an internal volume of about sixteen cubic inches and sized to be at least four times the internal volume of the heat exchanger. The heat exchanger has a length of between and and eight feet and the boiler is heated by an electric resistance heating means having a wattage of between 300 and 1200 watts, with the wattage increasing at a rate of approximately 150 watts per half cubic inch increase in internal system volume in the internal volume range set forth above.

3 Claims, 1 Drawing Sheet

ELECTRIC FINNED-TUBE BASEBOARD SPACE HEATER EMPLOYING A VAPORIZED WORKING FLUID

BACKGROUND OF THE INVENTION

Self-contained space heaters of one type or another have been around for many years, some fired by kerosene or other liquid fuels, others by natural gas or propane and still others electrically. Many such heaters are portable and can be used anywhere from a duck blind to the living room. Those using natural gas or electricity are, of course, confined in their applications to where such sources of fuel and power are available.

One distinct advantage of the electrically-heated units is that they do not require venting and, therefore, are considered much safer than those which emit fumes or even require oxygen for combustion. Many such heaters are used as a supplementary, as opposed to a primary, source of heat, the main source being a hot air or hot water furnace.

There are several factors that should be considered in purchasing a small space heater in addition to the primary one of BTU output per unit of fuel, be it a combustible liquid or gas or energy in the form of electricity. Among these are, of course, safety, portability, initial cost, appearance, heat-up time and versatility.

FIELD OF THE INVENTION

It is to the class of baseboard-type heaters that the present invention relates and, more specifically, to those using an electrically-heated element of some sort to heat up and, perhaps, even vaporize a liquid in a closed boiler.

DESCRIPTION OF THE RELATED ART

One of the most pertinent prior art references known to applicant is the early Decker U.S. Pat. No. 1,919,204. An ethylene glycol/water mixture is used as the working fluid in a closed system having an inclined fined-tube heat exchanger heated by an electrical heating element; however, the teaching of this patent is that the working fluid is not to be permitted to vaporize which is contrary to the teaching of the invention disclosed and claimed herein which system operates at subatmospheric pressures and relies upon this fact for improved performance and more efficient heat transfer. An even earlier Gold U.S. Pat. No. 1,043,922 is, likewise, pertinent in that it reveals a closed system operating at subatmospheric pressure, however, it uses water as the working fluid in place of a miscible mixture including ethylene glycol which applicant has found to be superior to water alone in his particular system. The teaching of the Sturgis U.S. Pat. Nos. 3,927,297 and 4,223,205 is to use an ethylene glycol/water mixture as the working fluid as was the case with the Decker patent; however, in these Sturgis patents the mixture is boiled in a boiler like applicant's. These two Sturgis patents relate to a vertical system which differs from applicant's horizontal one. A third Sturgis U.S. Pat. No. 3,640,456, however, also deals with a horizontal system. It, too, differs from applicant's system in that it is a continuous loop system while the one forming the subject matter of the present application employs a single close-ended inclined finned-tube heat exchanger.

SUMMARY OF THE INVENTION

This invention relates to baseboard-type heaters characterized by a closed and slighlty inclined fined-tube expansion chamber defining a radiator that is in communication at its lower end with an electrically-fired boiler containing a mixture of ethylene glycol and water in proportions of approximately two parts glycol to one part water. Heat is supplied to the liquid in the boiler by an electrically-powered heating element. The size of the boiler is maintained substantially constant even though the length of the finned-tube varies between approximately one and eight feet. The same is true of the volume of the working fluid in the boiler, it being essentially the same regardless of the length of the finned-tube.

It is important to the operation of the heater that the operating pressures be maintained within certain limits, specifically, approximately a negative pressure of −5 p.s.i. to a maximum of about 15 p.s.i. and it has been found that this can be accomplished by leaving the volume of the working fluid and the size of the boiler essentially constant while increasing the wattage of the heating element about 150 watts for each increment of increase in finned-tube volume of just slightly less than one-half cubic inch, all without regard to the input voltage. By so doing, the heating element will almost immediately vaporize the working fluid mixture and raise the temperature of the radiator from ambient to about 190° F. As the system pressure rises to around 15 p.s.i., the radiator temperature will go up to a maximum of around 250° F. The combination of the use of a relatively concentrated high-boiling-point immiscible working fluid mixture together with a carefully controlled negative-to-positive pressure gradient achieved by incremental increases in input energy into a system where the total closed volume consisting of the boiler and finned-tube rises no more than approximately 18% from the smallest size to the largest, all cooperate to produce a baseboard type heater which is efficient, safe and, most of all, effective to heat the surrounding environment.

It is, therefore, the principal object of the present invention to produce a novel and improved electrically-powered baseboard-type space heater.

A second objective is to provide a heater of the type aforementioned which can be produced in a variety of lengths designed to accommodate the needs of the user.

Another object of the invention herein disclosed and claimed is that of providing a safe, yet efficient, space heater.

Still another objective is the provision of a heater of the type aforementioned which heats up quickly and maintains an output temperature of between approximately 190° F. and 250° F. at a maximum pressure of 15 p.s.i.

An additional object is to provide an electrically-powered baseboard heater that is adaptable for use on either 110 volt A.C. or 220 volt D.C. household current.

Further objects are to provide a space heater which is versatile, simple to operate, inexpensive yet efficient, compact and even decorative.

Other objects will be in part pointed out specifically hereinafter in connection with the drawings that follows.

DESCRIPTION OF THE PREFERRED EMBODIMENTS

Figure 1:
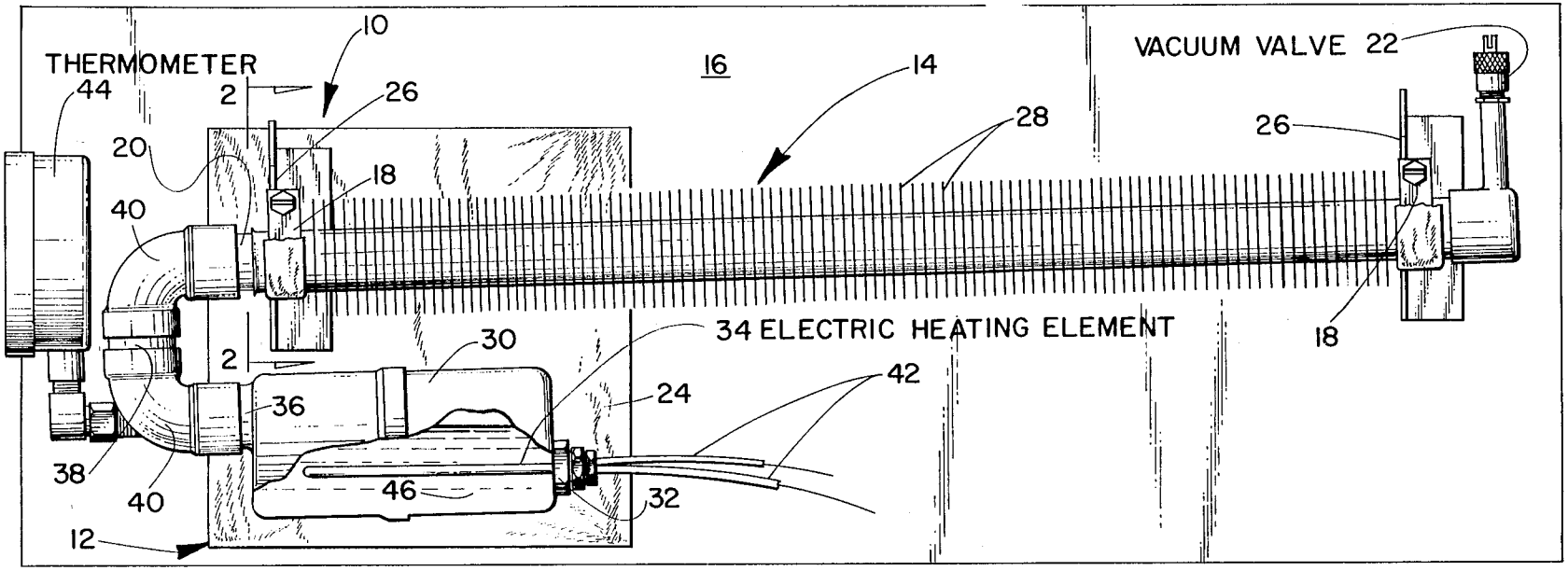
FIG. 1 is a front elevation of the space heater, portions having been broken away to more clearly reveal the interior construction.
Figure 2:
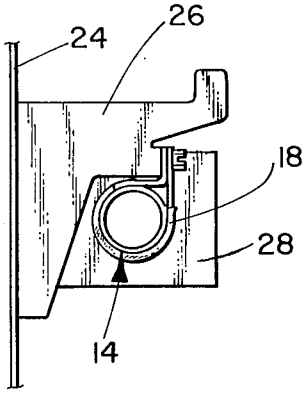
FIG. 2 is a vertical section taken along line 2—2 of FIG. 1.

Referring next to the drawings for a detailed description of the present invention and, initially, to FIGS. 1 and 2 for this purpose, reference numeral 10 has been chosen to refer broadly to the space heater in its entirety while numerals 12 and 14 similarly designate the boiler and the finned-tube heat exchanger or radiator, respectively. Radiator 14 is fastened in the particular form shown to a backplate 16 by means of clamps 18 or other fasteners such that it has a slight upward inclination from its intake end 20 to the upper closed end thereof where vacuum valve 22 is located. It has been found that an inclination of between approximately one-eighth and a quarter inch to the foot is inadequate to insure return flow of the condensate back into the boiler.

Interposed between the backplate and the boiler 12 is a heat-resistant barrier 24 in the form of a small sheet of asbestos or similar fireproof material. Clamps 18 are shown attached to hanger brackets 26 which are, in turn, mounted on the backplate. While not shown, the assembly of FIG. 1 is preferably housed in a housing of conventional design that is open in the area of the radiator to allow the heat radiated from the latter to move out and into the adjacent living space. The finned-tube is, of course, standard, the one shown being made of copper and having an internal diameter of about three-fourths inch. A plurality of fins 28 are spaced along the full length of the copper tube and greatly increase its effective area.

Vacuum valve 22 is of standard design and it is used to pump down the interior of the system to a normal pressure of −5 p.s.i. prior to the boiler being heated fired. As illustrated, the boiler 14 takes the form of a small two-piece cylindrical chamber 30 having an opening 32 in one end near the bottom for the reception of the heating element 34 and the second opening 36 higher up on the other end where the vapors from the working fluid exit the latter and enter the heat exchanger 12. A short nipple 38 and two elbows 40 cooperate to define the U-shaped connection between the heat exchanger and the boiler that positions the latter beneath the former as shown. Insulated electrical leads 42 carry power to the heating element.

Figure 3:
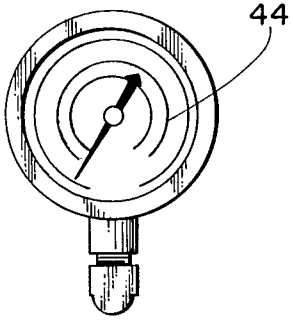
FIG. 3 is an end view showing a thermometer positioned to measure the temperature of the vapors leaving the boiler and entering the finned-tube heat exchanger.

In FIGS. 1 and 3, it can be seen that a thermometer 44 has been connected into the U-shaped connection between the boiler and the heat exchanger in position to measure the temperature of the vapors moving therebetween. Obviously, this thermometer, a pressure gauge in place thereof, or any other instrumentation are for informational purposes only and have no functional significance; therefore, they may be eliminated without effecting the operation of the system in any way whatsoever.

It has now been found that certain critical relationships exist between the concentration of the working fluid 46 in terms of its ability to raise the boiling point, the volume of the system, the heat supplied to the working fluid and the pressure, all of which interact to define a safe, yet efficient, space heater effective to quickly raise the temperature of the surroundings while, at the same time, presenting no hazard to the occupants. Specifically, a working fluid having approximately two parts ethylene glycol to one part water has been found most satisfactory for use in combination with a system having an internal volume of between about seventeen cubic inches and twenty cubic inches where the power supplied to the boiler varies between about 300 and 1200 watts, the wattage increasing at the rate of approximately 150 watts per half cubic inch increase in system volume in that range, with theheat exchanger internal volume being adapted to increase approximately one half cubic inch for every one foot increase in length thereof. Of course, it makes no difference whether the power is supplied to the heater by a 110 volt or a 220 volt line.

For best results, the volume of the boiler should exceed that of the heat exchanger by at least a factor of 4 to 1. A boiler slightly under six inches long having an internal volume of sixteen or so cubic inches has adequate volume to hold six ounces or so of the working fluid and still leave sufficient room above the fluid for vaporization to take place. Moreover, this same six ounces of working fluid when vaporized will supply enough heat to heat anywhere from a one foot long to an eight foot long heat exchanger provided, of course, that the heat supplied is increased proportionately as above noted. More specifically, by operating within the approximately a 18% range variation in system volume from the minimum to the maximum as set forth above and a 300 to 1200 watt range in supplied energy, by starting at a negative pressure in the system of about −5 p.s.i., a 2 to 1 mixture of ethylene glycol to water will vaporize to produce enough heat to raise the temperature to between approximately 190° F. and 250° F. in a one foot long to an eight foot long finned-tube radiator without the pressure rising much above 15 p.s.i.

Accordingly, by carefully matching the volume of the system, its negative pressure and the power supplied to the heater to the concentration of a particular high-boiling-point working fluid, one is able to efficiently and quickly provide heat to the environment at an elevated, yet safe, temperature and pressure. Moreover, by merely changing two variables, specifically, the electrical energy supplied to the heater and the length of the heat exchanger, it is possible to vary the size of the heater and its output such as to accommodate those from just over a foot long to as much as eight feet in length.

What is claimed is:

1. In an electrically-powered space heater of the type having a boiler connected to deliver a high-boiling point mixture of ethylene glycol and water in the form of a vapor to an open end of a horizontally-disposed finned-tube heat exchanger and receive condensate therefrom, the heat exchanger being closed at the other end so as to cooperate with the boiler to produce a closed system, the improvement which comprises: the high-boiling point mixture comprising a 2 to 1 mixture of ethylene glycol and water, the boiler having an internal volume of about sixteen cubic inches and being sized to be at least four times the internal volume of the finned tube heat exchanger with the combined internal volumes of the boiler and the finned-tube heat exchanger being between about seventeen cubic inches and about twenty cubic inches, the boiler being sized to have an internal volume greater than the volume of the high-boiling point mixture in the system whereby there is room in said boiler for vaporization of the mixture, and the heat exchanger having a length of between about one foot and about eight feet, an electrical heating means operatively connected to the boiler to supply electrical energy to heat fluid in the boiler at a level between not less than about 300 watts and about 1200 watts with the wattage increasing at a rate of approximately 150 watts per half cubic inch increase in system volume in said internal volume range to boil said high-boiling point mixture at an initial pressure of approximately −5 p.s.i. and raise same to a temperature of between approximately 190° F. and 250° F. at a maximum working pressure of 15 p.s.i.

2. The improvement as set forth in claim 1 wherein: the internal volume of the boiler is approximately sixteen cubic inches and the internal volume of the heat exchanger increases approximately one half cubic inch for every foot increase in length thereof.

3. The improvement as set forth in claim 1 wherein: the closed end of the heat exchanger is elevated above its open end approximately one-eighth to one-quarter inch to the foot of overall length.

* * * * *